US005749740A

United States Patent [19]

Swift et al.

[11] Patent Number: 5,749,740

[45] Date of Patent: May 12, 1998

[54] BONDING STRAP FOR NON-METALLIC ELECTRICAL ENCLOSURE

[75] Inventors: Thomas R. Swift, Monroe; Kevin R. Richter, North Haven, both of Conn.

[73] Assignee: Hubbell Incorporated, Orange, Conn.

[21] Appl. No.: 717,506

[22] Filed: Sep. 20, 1996

[51] Int. Cl.[6] ..... H01R 13/648

[52] U.S. Cl. ..... 439/92

[58] Field of Search ..... 439/92, 95, 98

[56] References Cited

U.S. PATENT DOCUMENTS 3,887,258 6/1975 Cunningham et al. ..... 439/92

4,175,812 11/1979 Palmer .

4,392,012 7/1983 Nattel ..... 439/92

4,934,952 6/1990 Banker .

5,108,270 4/1992 Kozumplik et al. .

*Primary Examiner*—Gary F. Paumen

*Attorney, Agent, or Firm*—Jerry M. Presson; Leopold Presser

[57] ABSTRACT

A bonding strap for non-metallic electrical enclosures, which is directed to the provision of a metallic bonding strap for non-metallic, back-to-back electrical enclosures. The bonding strap facilitates automatic bonding between the bridge of bridge-mounted electrical devices which are installed in the enclosure and a grounding conductor terminated to the strap so as to provide two locations for attaching grounding conductors.

13 Claims, 3 Drawing Sheets

BONDING STRAP FOR NON-METALLIC ELECTRICAL ENCLOSURE

BACKGROUND OF THE INVENTION

1. Field of the Invention

The present invention relates to a bonding strap for non-metallic electrical enclosures, and more particularly, is directed to the provision of a metallic bonding strap for non-metallic, back-to-back electrical enclosures wherein the bonding strap facilitates automatic bonding between the bridge of bridge-mounted electrical devices which are installed in the enclosure and a grounding conductor terminated to the strap so as to provide two locations for attaching grounding conductors.

In essence, the inventive bonding strap for non-metallic electrical enclosures is adapted to be simply positioned within the enclosure by either manual pressure being imparted thereto or through the employment of a simple fixture, and wherein the bonding strap incorporates two sets of barbs adapted to graspingly engage stiffening ribs formed in the center of the electrical enclosure, the latter of which is generally formed of a rigid molded plastic material. A tab from the material of the bonding strap is adapted to be bent upwardly along each of the terminations so as to anti-rotate a terminal nut at each respective end, and is extended above the bearing surface of the termination screw to act a as wire bundling structure for wires which are bound directly beneath the screw head of the termination screw. The provision of the inventive bonding strap eliminates the need for a bonding jumper to be interposed between the ground terminal of each electrical device and a grounding conductor. A second grounding conductor attachment can be employed for the attachment of the out-going or feed-through cable grounding conductor.

2. Discussion of the Prior Art

The utilization of bonding straps for various types of electrical devices is well known in various aspects of the electrical equipment technology.

Kozumplik, Jr., U.S. Pat. No. 5,108,270 disclosures a fluid handling apparatus including a casing which is constructed from a conductive corrosion-resistant plastic material, and wherein the grounding thereof is implemented through the construction and installation of a bonding strap. In view of the foregoing bonding strip, the apparatus eliminates the build-up of electrostatic charges which may occur during combustible fluid transfer, thereby obviating the potential of an explosive condition being encountered by the apparatus. In this particular publication, the bonding strap consists of a simple metal strap material which is attached to the fluid handling apparatus through the intermediary of screw members and; in essence, does not provide for the versatility of the inventive metallic bonding strap construction for non-metallic electrical enclosures as disclosed herein.

Banker U.S. Pat. No. 4,934,952 discloses a corrosion-resistant bonding strap for connecting dissimilar metallic components, and comprises a flexible bonding strap structure having portions which are adapted to be attached to respective metal lugs for mechanical fastenings through a boss which is adapted to be welded to one of the major components which are being bonded.

Finally, Palmer U.S. Pat. No. 4,175,812 relates to an electrically conductive bonding strap for connecting movable components. The bonding strap is essentially constituted of a braided metal wire which has a clip soldered or connected at each end, and with the respective clip being shaped to follow the contour of a retainer which is designed to secure a rubber weather seal by means of a cable and groove arrangement. This type of structure is primarily used to remove static electricity or voltage which is built up as a result of electromagnetic pulses created by a large burst of electromagnetic energy released into the atmosphere and is particularly adapted to protect communication and navigation equipment in aircraft.

SUMMARY OF THE INVENTION

Accordingly, the present invention provides for a metallic bonding strap for non-metallic electrical enclosures; for instance, such as back-to-back electrical enclosures of box-like configuration, and which are preferably constituted of a molded plastic material. The electrical enclosure is adapted to have bridge-mounted electrical devices installed therein, and in which the bonding strap provides for automatic bonding between the bridge and a mounting screw of each electrical device. In this connection, the bonding strap incorporates two locations for attaching grounding conductors, thereby obviating the necessity of providing for a bonding jumper between the ground terminal of each electrical device and the grounding conductor. The second of the grounding conductor attachments for the bonding strap can be employed for the attachment of the out-going or feed-through cable grounding conductor.

The inventive metallic bonding strap is designed to be pressed into place within the electrical enclosure during assembly either manually or by means of a simple assembling fixture in that a pair of barbs which are formed on the bonding strap each graspingly engage a stiffening rib molded in the center of the box-shaped electrical enclosure. Furthermore, a tab of the bonding strap material, the latter of which is essentially constituted of sheet metal, preferably steel or brass, is extended to reach above the bearing surface of a termination screw so as to act as a wire bundling feature for wires which are bound directly beneath the head of the screw, thereby imparting a high degree of versatility to the use of the bonding strap.

Accordingly, it is a primary object of the present invention to provide a novel metallic bonding strap construction for non-metallic electrical enclosures.

A more specific object of the present invention is to provide a metallic bonding strap for non-metallic electrical enclosures, incorporating structure for clampingly engaging stiffening ribs which are arranged in the center of the box-shaped electrical enclosure.

A further object of the present invention residues in the provision of a bonding strap of the type described herein which provides automatic bonding between the bridge and mounting crew of a pair of electrical devices which are bridge-mounted and installed in a back-to-back electrical enclosure, and which provides two locations for attaching grounding conductors, thereby obviating the need for a bonding jumper to be located between the ground terminal of each electrical device and a grounding conductor.

Still another object of the present invention is to provide a metallic bonding strap of the type described wherein a second grounding conductor attachment in the form of a termination screw can be utilized for the attachment of an outgoing or feed-through cable grounding conductor.

A yet more specific object of the present invention resides in the provision of a metallic bonding strap of the type described, in which a tab of the bonding strap material is bent up alongside each of the terminations for the mounting screws so as to anti-rotate the terminal nut for the screw, and which tab is extended above the bearing surface of the termination screw to act as a wire bundling feature for wires which are bound directly beneath the screw head of the termination screw.

BRIEF DESCRIPTION OF THE DRAWINGS

Reference may now be had to the following detailed description of a preferred embodiment of the invention, taken in conjunction with the accompanying drawings; in which.

DETAILED DESCRIPTION OF A PREFERRED EMBODIMENT

Figure 2:
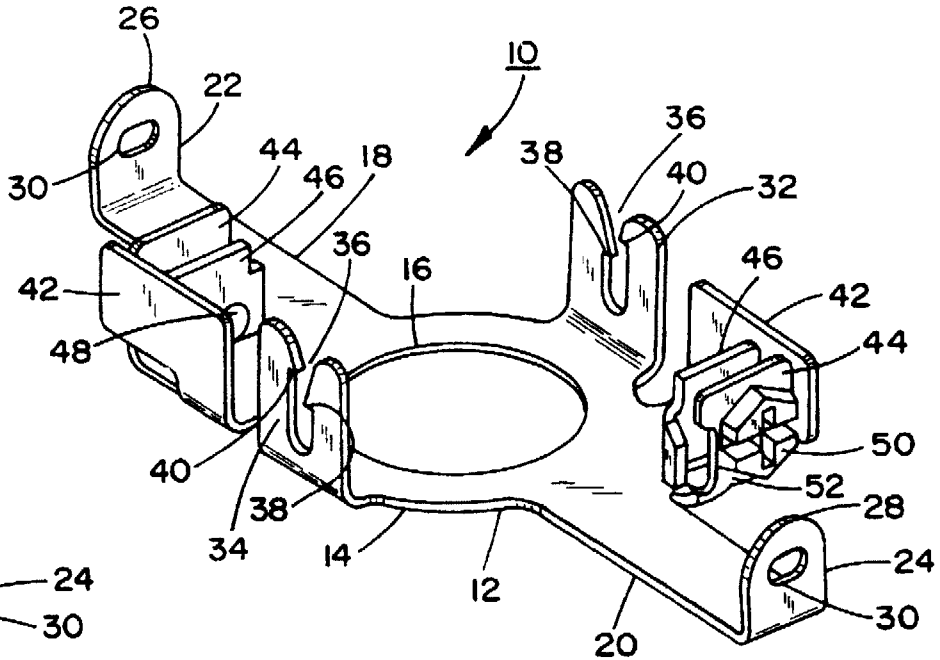
FIG. 2 illustrates a bottom and side perspective view of the bonding strap of FIG. 1.
Figure 1:
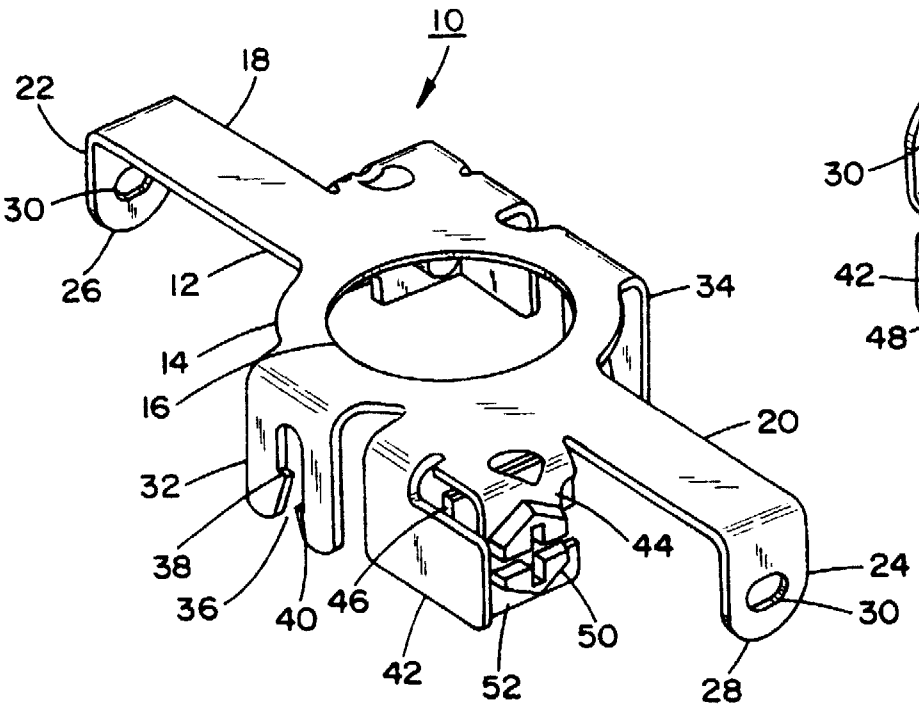
FIG. 1 illustrates a top and side perspective view of a metallic bonding strap constructed pursuant to the invention.

Referring now in greater particularity to the drawings, and especially FIGS. 1 and 2, there is disclosed the inventive bonding strap 10 which is constituted of a metallic material, preferably, brass or steel which are good electrically conductive in property. The bonding strap 10 is preferably formed of a sheet metal construction and maybe either cut or stamped and thereafter bent into its appropriate configuration, as illustrated in the drawings.

In this instance, the bonding strap 10 includes a generally planar or flat structure constituting of a large surfaced elongate portion 12 having a wide central section 14 with an aperture 16 formed therein for the through passage of suitable electrical components (not shown). Extending radially therefrom in opposite axial directions from the central portion 14 are coplanar first and second arms 18 and 20. The distal ends 22, 24 of the respective arms 18, 20 are bent downwardly at approximately 90° relative to the planar surface of the arms 18, 20 and portion 12, so as to form short dependent flanges 26, 28. Each flange has a through hole 30, preferably of slotted configuration formed therein to provide locations for the mounting screws of suitable electrical devices, as described further on hereinbelow.

Extending from the central planar portion 14 of the bonding strap 10 transversely of the extent of arms 18, 20 are further planar portions 32, 34, in effect, at a right angle to the axial extent of the arms 18, 20, and on opposite sides of central section 14, these planar portions 32, 34 are bent downwardly at 90° relative to the planar extent of the arms 18, 20. In each of these downwardly depending portions 32, 34 is a slotted cutout 36 with barbs 38, 40 on the facing surfaces thereof.

Adjacent one side of each of the downwardly depending portions 32, 34 containing the slots 26 with the barbs 38, 40 formed therein are further depending L-shaped plate portions 42 which are adjacent and at right angles further downwardly bent plate members 44 and therewith parallel spaced, plate surfaces 46 thereto. The elements 44 and 46 contain apertures 48 for the through-passage of termination screws (not shown), and with an anti-rotation termination nut 50, located on the outer face 52 of each plate member 44 to provide grounding conductor connections. The depending plate portions 44, 44, 46 and their orientations relative to each other form guiding surfaces to provide an anti-rotation structure for the termination nut 50 and also a wire bundling feature as the wires are wound about the termination screw between elements 44 and 46.

As shown in FIGS. 1 and 2, the termination nut 50 anti-rotation feature and wire binding plate structure is provided at both or opposite sides of the bonding strap 10 for back-to-back electrical devices.

The installation of the inventive bonding strap 10 in connection with a non-metallic back-to-back electrical enclosure 60 is illustrated in more specific detail in FIGS. 3 to 6 of the drawings.

Figure 3:
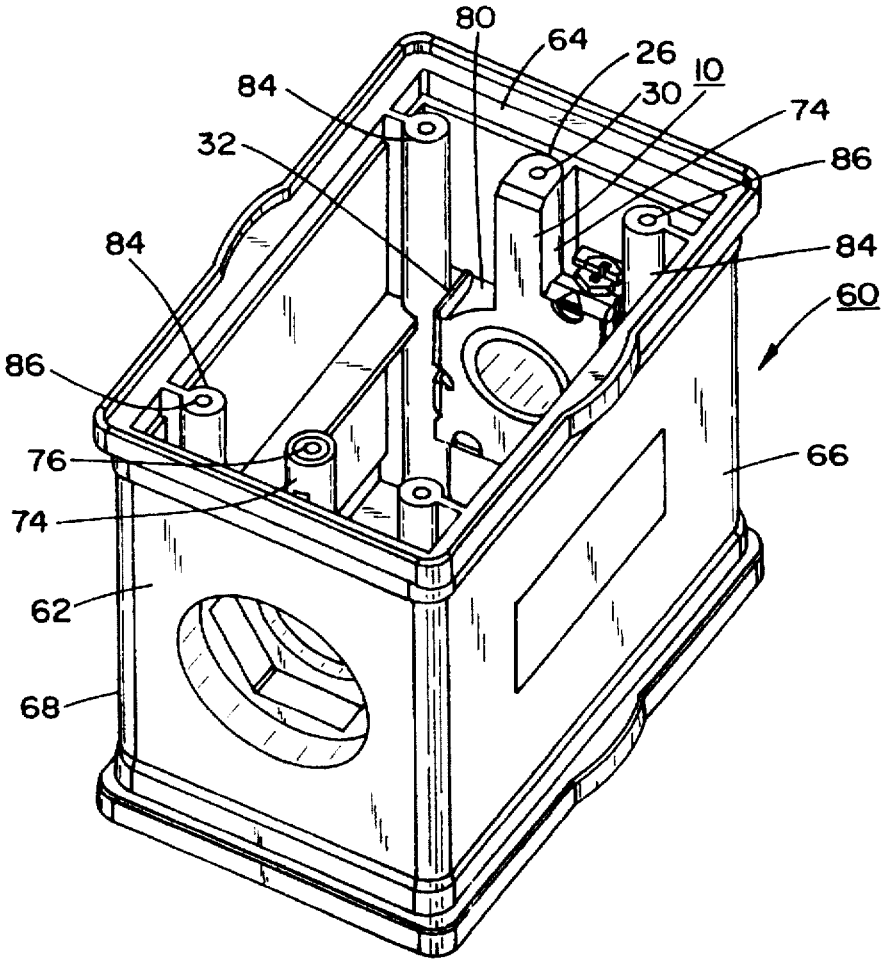
FIG. 3 illustrates a top and side perspective view of a non-metallic electrical enclosure of generally box-shaped configuration with the top thereof being open and showing the inventive bonding strap installed therein.
Figure 4:
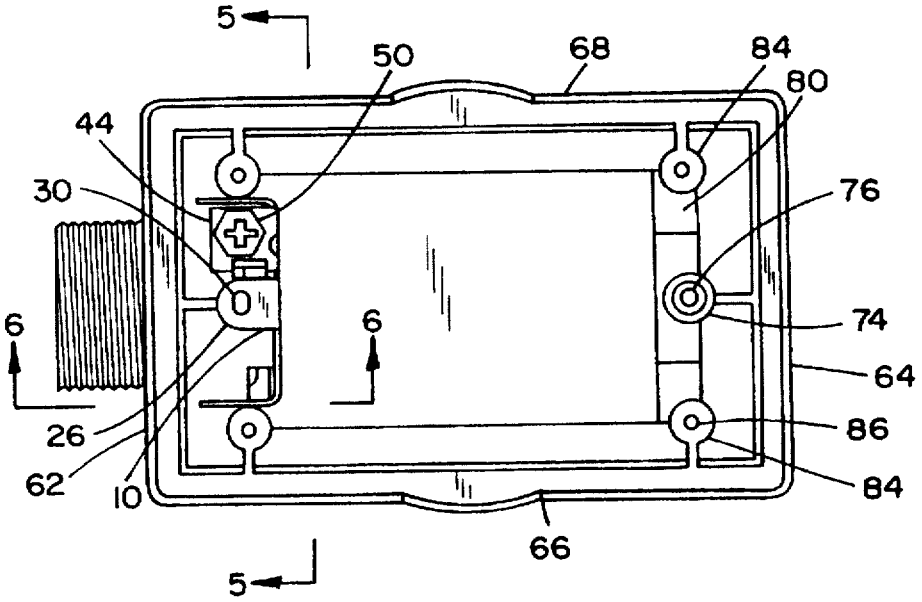
FIG. 4 illustrates a top plan view of the electrical enclosure with the bonding strap installed therein.
Figure 5:
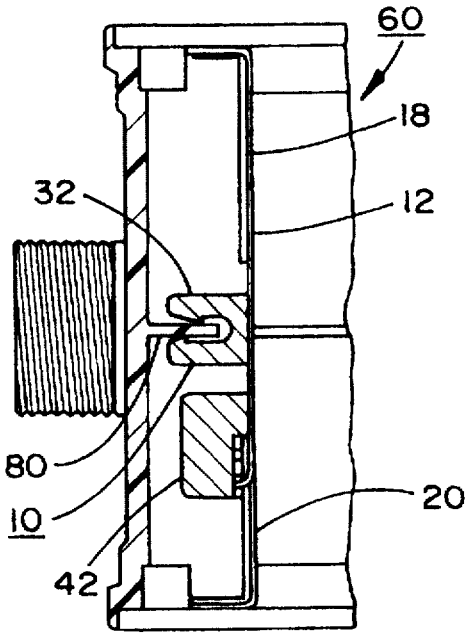
FIG. 5 illustrates a sectional view taken along line 5—5 in FIG. 4.
Figure 6:
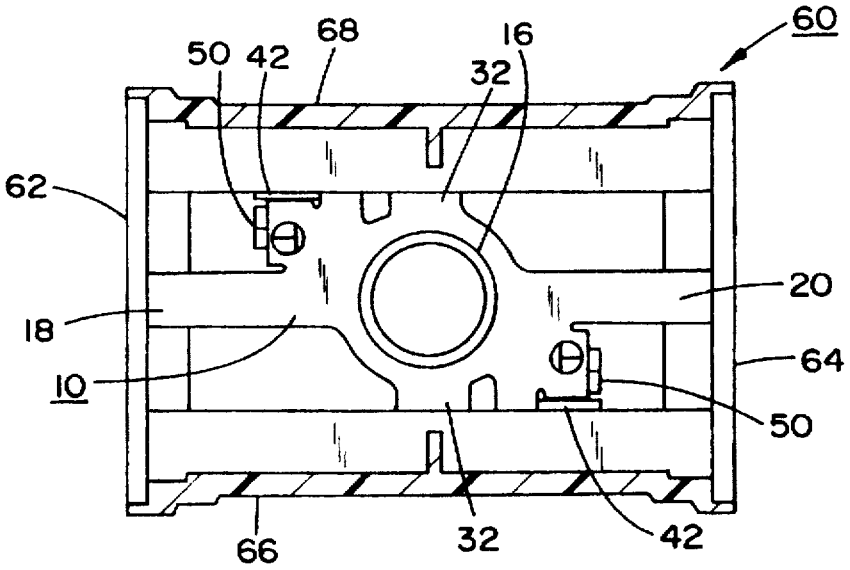
FIG. 6 illustrates a sectional view taken along line 6—6 in FIG. 4.

Referring in particular to FIGS. 3 and 4, the electrical enclosure 60 is constituted of a generally rectangular molded plastic box structure having front and rear walls 62, 64 and sidewalls 66, 68; for example, consisting of a rigid polypropylene or any other suitable electrically non-conductive plastic material, and includes a through opening 70 in each wall 62, 64 for the passage there through of electrical conductors and/or various equipment of electrical devices (not shown) adapted to be installed in the electrical enclosure 60.

The electrical devices which are to be located at opposite ends of the electrical enclosure 60 in preferably "back-to-back" relationship are each adapted to be fastened to the slotted holes 30 in the opposite flanges 26, 28 of the bonding strap 10 by means of suitable fastening screws (not shown), two bonding straps being provided one each at opposite sides of the electrical enclosure 60. The electrical enclosure 60 includes integrally molded upstanding posts 74, each having a threaded bore 76 formed therein to receive suitable fastening or machine screws for mounting the slotted holes 30 in the respective bonding strap 10; for example, each slotted hole 30 being in an interference fit with the machine screw so as to form a fixed interconnection with the electrical device adapted to be retained thereby.

Furthermore, the electrical enclosure 60 is equipped with internal integrally molded central ribs 80 which are clampingly grasped on opposite sides thereof by the barbs 38, 40 in slots 36 located on each side of the bonding strap 10, thereby forming a fixed and rigidly supported interconnection between the various components, in effect, the bonding strap, electrical devices and electrical enclosure.

Similarly, the portions of the bonding strap forming the termination nut anti-rotation and wire bundling features is adapted to be positioned in close contact with vertical end posts 84 in the electrical enclosure 60 so as to prevent any undue wobbling movement or displacement of the components housed therein.

The novel bonding strap 10 having the inventive terminations eliminates the need for providing a bonding jumper between the ground terminal of each respective electrical device fastened to a respective bonding strap 10 and a grounding conductor, and also provides for automatic bonding between the bridge and mounting screw of each electrical device when the electrical devices are installed bridge-mounted in the electrical enclosure 60. One of the grounding conductor attachments may be employed for the attachment of an out-going or feed-through cable grounding conductor (not shown).

As illustrated, the electrical enclosure 60, upon all of the components being installed therein and with the electrical devices each being fastened to a respective bonding strap 10, may have a suitable cover (not shown) attached thereto and by means of suitable fasteners, such as screws, fastened to threaded bores 86 forward in the corner end posts 84 of the enclosure. The bonding straps 10 are adapted to be pressed into fixed position within the electrical enclosure 60 during assembly by simply manual pressure being imparted thereto or through a simple fixture causing the slotted cutout 36 at each side of each bonding strap 10 containing the box to fixedly cause the barbs 38, 40 to engage the central ribs 80 which are molded in the electrical enclosure 60.

From the foregoing it readily becomes apparent that the inventive metallic bonding strap 10 not only serves to provide for a suitable electrical grounding interconnection between electrical devices, but also incorporates the features of being simply assembled into a suitable non-metallic electrical enclosure 60 by being pressed into position therein, while, incorporating wall structure and termination nut-anti-rotation and wire bundling features, thereby eliminating the need for various extraneous components while rendering the entire assembly simple to effect without the necessity for specialized tools or fixtures.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A bonding strap for at least one electrical device arranged in a non-metallic electrical enclosure, said bonding strap comprising an elongated planar member; means at opposite ends of said elongated planar member for fastening said bonding strap to an electrical device; a central aperture in said elongated planar member intermediate the opposite ends thereof; means extending transversely in a center portion of said elongated planar member for clampingly engaging interior surface structure of said electrical enclosure; and means on opposite sides of said elongated planar member forming terminations for grounding conductors.

2. A bonding strap as claimed in claim 1, wherein said fastening means at the opposite ends of said elongated planar member comprise angularly bent end portions forming flanges; and slotted apertures being formed in each of said flanges to facilitate passage therethrough of fasteners for engagement with the electrical device.

3. A bonding strap as claimed in claim 2, wherein said flanges extend at right angles from said elongated planar member.

4. A bonding strap as claimed in claim 1, wherein said means extending transversely from said center portion of said elongated planar member comprise oppositely located bent portions of said member; slot means formed in each of said bent portions so as to extend from the free ends thereof, and barbs formed in said slot means for clampingly engaging interior surface structure of said electrical enclosure so as to retain said bonding strap in fixed position in said enclosure.

5. A bonding strap as claimed in claim 4, wherein each said bent portion comprises a flat plate element extending at right angles from said elongated planar member in mutually parallel spaced relationship.

6. A bonding strap as claimed in claim 1, wherein said termination forming means comprise bracket structure extending at angularly bent relationships from said elongated planar member in adjacently spaced relationship with each of said clamping means axially offset in opposite directions from the center portion of said member; each said termination forming means mounting an anti-rotation nut for a termination screw.

7. A bonding strap as claimed in claim 6, wherein said bracket structure of each termination forming means includes parallel spaced plates having a tab forming a space therebetween to facilitate binding of electrical conductors in conjunction with said anti-rotation nut.

8. A bonding strap as claimed in claim 1, wherein said strap is of a unitary construction constituted of an electrically-conductive metallic material.

9. A bonding strap as claimed in claim 8, wherein said metallic material comprises brass.

10. A bonding strap as claimed in claim 8, wherein said metallic material comprises steel.

11. A bonding strap as claimed in claim 8, wherein said strap is constituted of sheet metal.

12. A bonding strap as claimed in claim 1, wherein said electrical enclosure is a box-shaped molded plastic housing having internal rib structure clampingly engageable by the clamping means of said bonding strap.

13. A bonding strap as claimed in claim 12, wherein said housing is adapted to receive back-to-back bridge-connected electrical devices.

* * * * *